US005595641A

United States Patent [19]

Traini et al.

[11] Patent Number: 5,595,641

[45] Date of Patent: Jan. 21, 1997

[54] APPARATUS AND PROCESS FOR ELECTROCHEMICALLY DECOMPOSING SALT SOLUTIONS TO FORM THE RELEVANT BASE AND ACID

[75] Inventors: Carlo Traini, Milan; Giuseppe Faita, Novara, both of Italy

[73] Assignee: DeNora Permelec S.p.A., Italy

[21] Appl. No.: 157,180

[22] PCT Filed: Jun. 26, 1992

[86] PCT No.: PCT/EP92/01442

§ 371 Date: Dec. 8, 1993

§ 102(e) Date: Dec. 8, 1993

[87] PCT Pub. No.: WO93/00460

PCT Pub. Date: Jan. 7, 1993

[30] Foreign Application Priority Data

Jun. 27, 1991 [IT] Italy ..... MI91A1765

[51] Int. Cl.[6] ..... C25B 1/00

[52] U.S. Cl. ..... 205/464; 205/508; 205/510; 205/555; 205/554; 204/258; 204/263; 204/257; 204/265

[58] Field of Search ..... 204/258, 263, 204/257, 265, 72, 103, 104, 129; 205/464, 508, 510, 555, 554

[56] References Cited

U.S. PATENT DOCUMENTS

| | | | |
|---|---|---|---|
| 3,124,520 | 3/1964 | Juda | 204/104 |
| 4,299,674 | 11/1981 | Korach | 204/128 |
| 4,331,521 | 5/1982 | Chisholm et al. | 204/283 |
| 4,561,945 | 12/1985 | Coker et al. | 204/98 |
| 4,565,612 | 1/1986 | Fry | 204/98 |
| 5,256,261 | 10/1993 | Lipsztajn et al. | 204/98 |
| 5,258,106 | 11/1993 | Habermann et al. | 204/98 |

FOREIGN PATENT DOCUMENTS

| | | | |
|---|---|---|---|
| 0042778 | 3/1983 | Japan | 204/128 |
| 1142093 | 6/1989 | Japan . | |

*Primary Examiner*—Kathryn Gorgos
*Attorney, Agent, or Firm*—Bierman and Muserlian

[57] ABSTRACT

Electrolyzer comprising at least one elementary cell divided into electrolyte compartments by cation-exchange membranes, said compartments are provided with a circuit for feeding electrolytic solutions and a circuit for withdrawing electrolysis products, said cell is equipped with a cathode and a hydrogen-depolarized anode assembly forming a hydrogen gas chamber fed with a hydrogen-containing gaseous stream, characterized in that said assembly comprises a cation-exchange membrane, a porous, flexible electrocatalytic sheet, a porous rigid current collector having a multiplicity of contact points with said electrocatalytic sheet, said membrane, sheet and current collector are held in contact together by means of pressure without bonding.

14 Claims, 5 Drawing Sheets

APPARATUS AND PROCESS FOR ELECTROCHEMICALLY DECOMPOSING SALT SOLUTIONS TO FORM THE RELEVANT BASE AND ACID

This application is a 371 of PCT/EP92/01442 filed Jun. 26, 1992.

BACKGROUND OF THE INVENTION

The electrolytic production of chlor-alkali the most widespread process in the electrochemical field. This process utilizes sodium chloride which is converted into sodium hydroxide and chlorine by applying electric current.

Also known, even if not so common, is the process based on the use of potassium chloride as starting material, to obtain potassium hydroxide and chlorine as final products. Chlorine and caustic soda may be also produced respectively according to the methods schematically resumed as follows:

- electrolysis or catalytic oxidation of hydrochloric acid, available in large amounts as a by-product of the chlorination of organics. Hydrochloric acid may be further obtained by a reaction between sodium chloride and sulphuric acid, with the side-formation of sodium sulphate;
- causticization of a sodium carbonate solution with lime, subsequent filtration of the by-produced solid calcium carbonate and concentration of the diluted solution of sodium hydroxide containing various impurities deriving from the lime and from the sodium carbonate solution.
- Sodium carbonate is commonly produced by the process developed by Solvay, based on the conversion of sodium chloride brine into sodium bicarbonate, which is scarcely soluble, by means of a chemical reaction with ammonia, which is then recycled, and carbon dioxide. Bicarbonate is then converted into sodium carbonate by roasting.
- The raw materials comprise, therefore, sodium chloride, lime and carbon dioxide, both obtained from calcium carbonate, and the ammonia necessary to make up for the unavoidable losses.
- A further source of sodium carbonate is represented by trona or nahcolite mineral ores which contain sodium carbonate and bicarbonate and minor percentages of other compounds, such as sodium chloride.

It is evident that the above alternatives are based on complex processes which involve high operation costs. For these reasons, these processes were gradually abandoned in the past and the market become more and more oriented towards the chlor-alkali electrolysis process which is intrinsically simpler and energy-effective due to the development of the technology based on mercury cathode cells progressively evolved to diaphragm cells and now to membrane cells. However, chlor-alkali electrolysis is today experiencing a decline, which is connected to the rigid stoichiometric balance between the produced quantities of sodium hydroxide and chlorine. This rigid link was no problem when the two markets of chlorine polyvinyl chloride or (PVC, chlorinated solvents, bleaching in paper industry, various chemical reactions) and of sodium hydroxide (glass industry, paper industry, various chemical uses) were substantially balanced. Recently, a persistent downtrend in the chlorine market (reduced use of PVC and chlorinated solvents, decreasing use in the paper industry) combined with a robust demand of caustic soda, seemingly bound to increase in the near future, pushed the industry towards alternative routes for producing sodium hydroxide without the concurrent production of chlorine, in some cases even considered an undesirable by-product. This explains the revival of the sodium carbonate causticization process, notwithstanding its complexity and high costs.

In this scenery, the electrochemical industry is ready to propose alternative processes evolving from the existing ones (see C. L. Mantell, Industrial Electrochemistry, McGraw-Hill) and made more competitive by the availability of new materials and of highly selective ion exchange membranes. The most interesting proposal is represented by the electrolysis of solutions of sodium sulfate, either mined or as the by-product of various chemical processes. Electrolysis is carried out in electrolyzers made of elementary cells having two electrolyte compartments separated by cation-exchange membranes or in a more sophisticated design, electrolyzers made of three electrolyte compartment elementary cells containing anion- and cation-exchange membranes. This process, also known as sodium sulfate splitting, generates sodium hydroxide (15–25%), hydrogen, oxygen and, in the simplest design, diluted sodium sulphate containing sulphuric acid, or in the more sophisticated design, diluted sodium sulphate and pure sulphuric acid. While sodium hydroxide is a desirable product, pure sulfuric acid and even more the acid solution of sodium sulfate pose severe problems. fact, if these products cannot be recycled to the other plants in the factory, they must be concentrated, with the relevant high costs, before commercialization in a rather difficult market usually characterized by large availability of 96–98% sulphuric acid produced at low cost in catalytic large-scale plants. The evolution of oxygen at the anodes of the elementary cells of the electrolyzer further involves a high cell voltage, indicatively 3.5 Volts for the simpler design and 4.5–5 Volts for the more sophisticated design, operating in both cases at 3000 Ampere/$m^2$ of membrane. These high voltages implicate a high energy consumption (2,700–3,700 kWh/ton of caustic soda).

A method to solve the above problems is offered by the process disclosed in U.S. Pat. No. 4,636,289, K. N. Mani et al., assigned to Allied Corporation. According to the teachings of this patent, an aqueous solution of a sodium salt, preferably sodium sulfate, is fed to an electrolyzer equipped with bipolar membranes (water splitter) and the outlet acid stream comprising diluted sodium sulfate and sulfuric acid is neutralized by sodium carbonate, sodium bicarbonate or mixtures thereof. The resulting neutral sodium salt solution is purified and recycled to the water splitter (indirect electrolysis). Even if not specifically said in U.S. Pat. No. 4,636,289, this process permits to obtain caustic soda with limited energy consumptions (1500–2000 kWh/ton of caustic soda). The problem affecting this technology is represented by the weakness of the bipolar membranes which are attacked by oxidizing substances, require low current densities (in the range of 1000 Ampere/$m^2$), an extremely efficient purification of the sodium salt solution to remove bivalent metals, such as $Mg^{--}$, relatively low acid concentrations, with an increase of the operation costs due to the high flow rates of the solutions to be recycled. Further, also under the best operating conditions, the bipolar membranes are characterized by a rather short lifetime, in the range of about 1 year. These drawbacks may be overcome by substituting the water splitter described by Mani et al. with electrolyzers constituted by elementary cells divided in two electrolyte compartments by cation-exchange membranes and provided with oxygen-evolving anodes as previously described. These electrolyzers, as already said, have high energy consumptions but offer several important advantages. In fact, the cation-exchange membranes have a very satisfactory lifetime, over 2 years, typically 3 years, and are capable of operating under high current densities, around 3000 Ampere/$m^2$. As regards the content of bivalent metal ions, such as $Mg^{--}$, the required tolerance limits are not so strict as for water splitters equipped with bipolar membranes. However, certain impurities, such as organic substances and chlorides, must be kept under control as they could cause a premature deactivation of the oxygen-evolving anodes. Further, chlorides are oxidized to chlorine which mixes with oxygen, the main product of the process, in which event oxygen must be subjected to alkaline scrubbing to absorb chlorine, before release to the atmosphere.

A system to decrease the energy consumption electrolyzers is found in the technical literature, for example H. V. Plessen et al. —Chem. Ing. Techn. 61 (1989), N. 12, page 935. According to this teaching, the oxygen-evolving anodes may be substituted with gas diffusion anodes fed with hydrogen. Such gas diffusion anodes comprise a porous sheet containing a catalyst dispersed therein and are suitably made hydrophobic, in order to maintain the liquid immobilized inside the pores, as taught for example in EP 0357077. However, this kind of anode is completely unreliable when its dimensions are increased for example up to one square meter, as required by industrial applications and it is inserted in a high number of cells, as it is the case in commercial electrolyzers. In fact, unavoidable percolations of liquid take place in those areas where defects are present due to manufacturing or mishandling. These percolations prevent hydrogen from reaching the catalytic sites and cause dangerous plugging of the hydrogen circuit. Further, the solution coming into contact with the catalyst inside the pores of the sheet may cause deactivation when certain impurities are present, such as heavy metals frequently found in the solutions to be electrolyzed. Moreover, if the solution in contact with the catalyst contains reducible species which easily react with hydrogen, undesired by-products are formed and the process efficiency is decreased.

These shortcomings of the hydrogen depolarized anodes are overcome by the assembly disclosed in U.S. Pat. No. 3,124,520. According to the teachings of this patent, the hydrogen-depolarized anode assembly comprises a cation-exchange membrane and a porous electrocatalytic sheet in face-to-face contact. The membrane protects the sheet against percolations of the electrolyte and prevents contact between the catalyst particles of the sheet and poisoning impurities or reducible substances contained in the electrolyte. The teaching of U.S. Pat. No. 3,124,520 applied to sodium sulfate electrolysis is found in U.S. Pat. No. 4,561,945 where also construction details are illustrated. In particular, according to U.S. Pat. No. 4,561,945, the electrocatalytic sheet is obtained by sinterization of a mixture of catalyst particles and polymer particles and by bonding of the sinterized electrocatalytic sheet to the surface of the membrane by application of heat and pressure. This particular type of construction is made necessary as with the hydrogen depolarized anode assembly of U.S. Pat. No. 4,561,945, the catalyst particles of said electrocatalytic sheet are in contact only with hydrogen gas and with the membrane, no electrolyte being present on this side of the membrane but just on the opposite side. As the conductive path ensured by the electrolyte is not provided, the ionization of hydrogen may take place only in the points of direct contact between the catalyst particles and the membrane. The remaining surface of the catalyst particles not in contact with the membrane results completely inert. As a consequence, in order to obtain a useful current density for industrial applications it is required that a great number of individual particles contact the membrane at a plurality of points. This requirement may be accomplished according to the state of the art teachings only by bonding the membrane and the electrocatalytic sheet. It is soon apparent that said fabrication method is particularly expensive and intrinsically unreliable when applied to electrodes of large unit area, in the range of 1–2 square meters each, to be produced in a large quantity, in the order of some hundreds of pieces for each production lot. Actually, powerful pressing devices are required, working at controlled temperature and there is a remarkably high possibility that the membrane during pressing and heating be punctured or cracked if excessively dehydrated.

OBJECTS OF THE INVENTION

It is the main object of the present invention to solve the problems affecting prior art by providing for an electrolyzer and relevant electrolysis process, said electrolyzer comprising at least one elementary cell equipped with a novel hydrogen depolarized anode assembly which permits to avoid the bonding between the electrocatalytic sheet and the membrane. When applied to the membrane electrolysis of aqueous solutions of a salt to produce the relevant parent base and acid, such anode assemblies have the characteristics of not being subject to liquid percolations, being highly resistant to the poisoning action of impurities such as heavy metals contained in the electrolytes and of not reducing the reducible substances contained in the electrolyte. Said anode assembly may be fed with hydrogen-containing gas streams and more preferably with the hydrogen evolved at the cathodes of the same electrolyzer. The resulting cell voltage is particularly low as is the energy consumption per ton of produced base.

These and other advantages of the present invention will become apparent from the following detailed description of the present invention.

DESCRIPTION OF THE INVENTION

The present invention relates to an electrolyzer comprising at least one elementary cell divided into electrolyte compartments by ion-exchange membranes, said compartments being provided with a circuit for feeding electrolytic solutions and a circuit for withdrawing electrolysis products, said cell being equipped with a cathode and with a hydrogen-depolarized anode assembly which formes a hydrogen gas chamber fed with a hydrogen-containing gaseous stream. Said assembly is constituted by three elements: a cation exchange membrane, a porous electrocatalytic flexible sheet and a porous, rigid current collector. The porosity of both the electrocatalytic sheet and the current collector is required for the hydrogen gas to reach the catalyst particles located inside said sheet and in direct contact with said membrane.

The three elements constituting the assembly of the invention, that is membrane, electrocatalytic sheet and current collector, are simply pressed together by the pressure exerted by the electrolyte present on the face of the membrane opposite to that in contact with the electrocatalytic sheet and by the internal resilient structure of the electrolyzer. Such characteristic may be provided for example by a resilient mattress or similar devices installed inside the electrolyte compartments of the electrolyzer.

It has been surprisingly found that when said current collector is at the same time rigid and adequately thick and provided with a multiplicity of contact points with said electrocatalytic sheet, said electrocatalytic sheet being flexible, the cell voltage during electrolysis carried out at a current density of industrial interest results remarkably low and anyway similar to that obtained with the bonded membrane-electrocatalytic sheet assemblies described by the prior art. This result is much more surprising taking into account that on the side of the membrane in contact with the electrocatalytic sheet, that is the hydrogen gas chamber, no electrolyte is present, and therefore, the ionization reaction of hydrogen may take place only on those portions of the surface of the catalytic particles of said electrocatalytic sheet which are in direct contact with the membrane. The advantage of avoiding the procedure of bonding the membrane and the electrocatalytic sheet is an achievement of the outmost industrial interest as it allows for producing the hydrogen depolarized anode assembly in a simple, reliable and cost-efficient way. It is in fact sufficient to separately produce or purchase the membrane, the electrocatalytic sheet and the current collector which are then assembled and maintained in position in the industrial electrolyzer by means of a simple pressure exerted for example by resilient means included in the internal structure of the electrolyzer itself. Neither the membrane nor the electrocatalytic sheet are subjected to the violent stresses which are typical of the bonding procedure under pressure and heating. Therefore, routinary quality controls during manufacturing of the membrane and of the electrocatalytic sheet are sufficient to guarantee a high reliability of the hydrogen depolarized assembly during operation. In the preferred embodiment of the present invention, the current collector comprises an electroconductive, flat, coarse and thick screen which has the function of providing for the necessary rigidity and for the primary distribution of current and an electroconductive fine, flexible screen which has the function of providing for a high number of contact points with said electrocatalytic sheet.

By the term "screen" in the following description it is intended any form of conductive, porous sheet, such as wire mesh, expanded metal, perforated sheet, sinterized sheet, sheets having apertures therein, such as, but not limited to, venetian blinds. Said fine screen may be simply pressed against said coarse rigid screen by means of the pressure exerted by the electrolyte or by the internal resilient structure of the electrolyzer onto the membrane and the electrocatalytic sheet. Alternatively, said fine screen may be mechanically secured to said coarse screen, for example by spot-welding.

When the fine and the coarse screens are made of expanded metal sheet, it has been found that optimum results, that is lower cell voltages, when current densities in the range of 1000 to 4000 Ampere/square meter are applied to the electrolyzer, are obtained with a coarse expanded metal sheet having a thickness comprised between 1 and 3 millimeters (mm), with the diagonals length of the diamond-shaped apertures in the range of 4 to 20 mm. The fine expanded metal sheet must typically have a thickness up to 1 mm, with the diagonals length of the diamond-shaped apertures in the range of 0.5 to 12 mm. The fine screen must in any case be so flexible as to adapt to the profile of the rigid coarse screen under the pressure exerted by the electrolyte or by the internal resilient structure of the electrolyzer when not mechanically secured to said coarse screen. Likewise, said fine screen must be sufficiently flexible to perfectly adapt to the rigid coarse screen also during the operation of mechanical securing, for example by spot-welding. The final result is that the fine screen, in both cases, either mechanically secured or not to the rigid coarse screen, must have a homogeneous contact over the whole surface of the rigid coarse screen. As an alternative embodiment, the current collector may be constructed with different geometrical solutions provided that the concurrent rigidity and multiplicity of contact points are ensured. For example, current collectors made by sinterized conductive sheets having a maximum pore diameter of 2 mm and a thickness in the range of 1 to 3 offer a satisfactory performance although their cost is remarkably higher than that of the current collector made of coarse and fine screens.

The current collector as above described may be made of conductive materials characterized by a good and stable-with-time surface conductivity. Examples of such materials are graphite, graphite-polymer composites, various types of stainless steels and nickel alloys, nickel, copper and silver. In the case materials forming an insulating surface film are used, such as for example valve metals such as titanium, zirconium or tantalum, the surface of the current collector must be provided with an electroconductive coating made of noble metals such as gold, platinum group metals and their oxides or mixtures of their oxides with valve metal oxides.

The above mentioned characteristics of the current collector, that is rigidity, thickness and multiplicity of contact points with the electrocatalytic sheet are all absolutely essential. In fact, the rigidity permits to press the membrane and the electrocatalytic sheet against the current collector thus obtaining a high contact pressure among the three elements without causing any concurrent deformation of the membrane along its periphery as would happen with a flexible collector which would unavoidably rupture the delicate membrane.

The thickness ensures for a homogeneous distribution of current also on large surfaces. The multiplicity of contact points makes the distribution of current homogeneous also on a microscale, which fact is necessary as most frequently the electrocatalytic sheets are characterized by reduced transversal conductivity. Further, the multiplicity of contact points between the current collector and the electrocatalytic sheet results in a similarly high number of contact points between the electrocatalytic sheet and the membrane, which ensures for a substantially complete utilization of the surface catalytic sites of said sheet with an efficient distribution of the current onto each site with a consequently low cell voltage. The porous electrocatalytic sheet may be a thin film obtained by sinterization of particles of a catalyst and a binder, porous laminates of carbon or graphite containing small amounts of catalysts, either in the form of micron-size particles or coating, and, as a further alternative, also fine metal wire meshes or sinterized metal sheets coated by a thin catalytic layer. The catalyst may be applied by one of the several known techniques such as deposition under vacuum, plasma spray, galvanic deposition or thermal decomposition of suitable precursor compounds. In any case the electrocatalytic sheet must be porous in order to permit to hydrogen diffusing through the porous current collector to reach the catalyst sites in direct contact with the membrane. Said sheet must be also sufficiently flexible to accomodate to the profile of the current collector thus increasing as much as possible the number of contact points already favored by the above described geometry of the current collector itself. On the other hand, the intrinsic flexibility of the membrane ensures also for the maximum number of contact points between the surface of the catalyst of the sheet and the membrane itself, provided that the same be supported by the rigid current collector. As there is a build-up of migrating protons in the membrane during electrolysis, said membrane should be of the type characterized by high chemical resistance to strong acidity.

BRIEF DESCRIPTION OF THE DRAWINGS

The electrolyzer structure and the process of the present invention will be described making reference to the figures, wherein.

The same reference numerals have been used for all of the figures to define the same parts and the same solution and gas streams.

DESCRIPTION OF PREFERRED EMBODIMENTS

Figure 1:
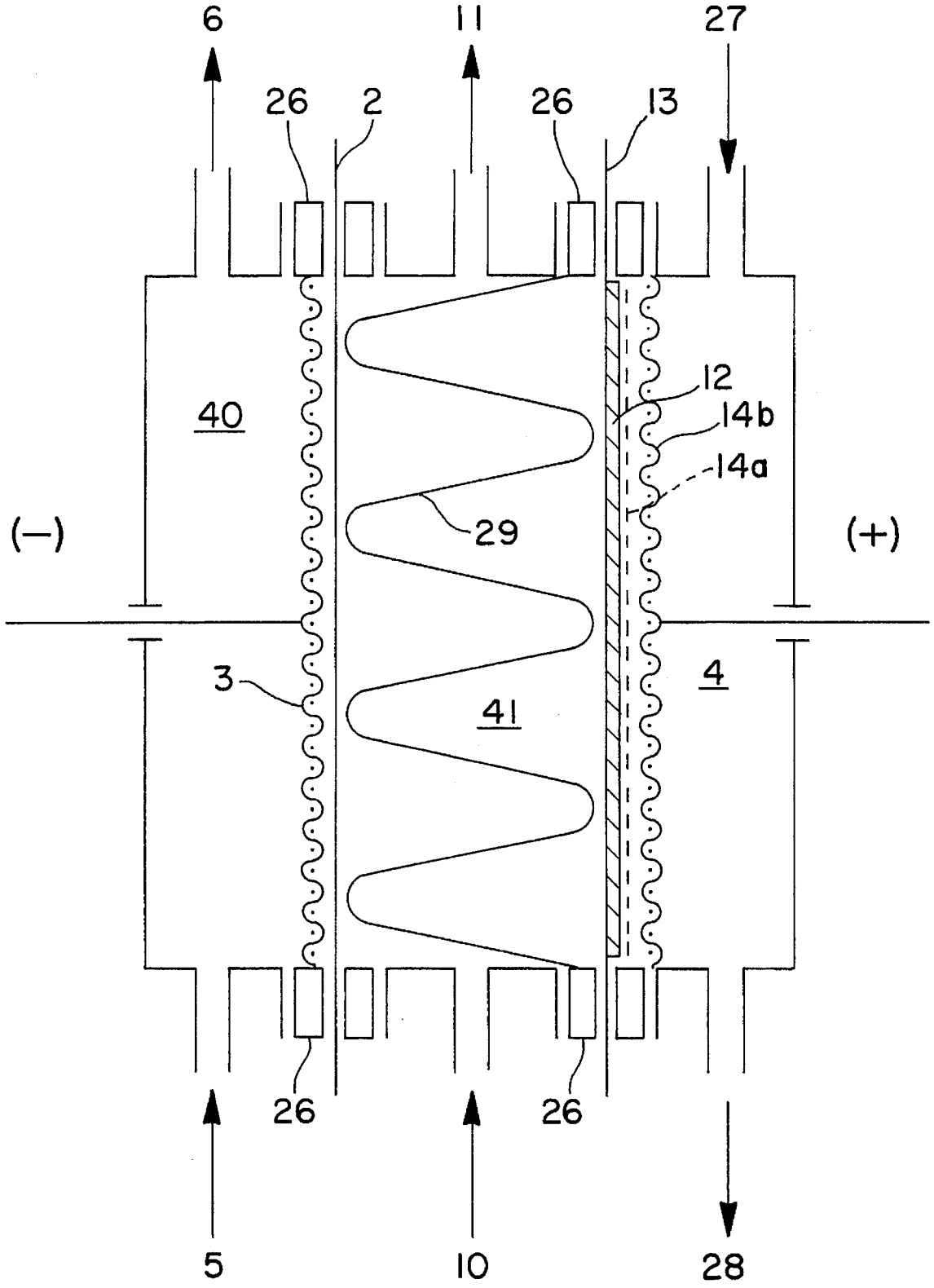
FIG. 1 is a scheme of the electrolyzer limited for simplicity sake to the illustration of one elementary cell only, comprising the hydrogen depolarized assembly of the present invention. The industrial electrolyzers will comprise a multiplicity of such elementary cells, electrically connected in both monopolar and bipolar arrangements.

Making reference to FIG. 1, the elementary cell is divided by cation-exchange membrane 2 in two electrolyte compartments, the cathodic compartment 40 containing cathode 3 and provided with inlet and outlet nozzles 5 and 6, and the central compartment 41 containing the spacer 29, provided with inlet and outlet nozzles 10 and 11. Said central compartment is further defined by the hydrogen depolarized anode assembly of the present invention, which forms a hydrogen gas chamber 4. Gas chamber 4 is provided with an inlet nozzle 27 for feeding a hydrogen-containing gaseous stream and an outlet nozzle 28 for venting the rest gas. The hydrogen depolarized anode assembly of the present invention comprises a cation-exchange membrane 13, an electrocatalytic sheet 12 and a current collector made of a fine electroconductive screen 14*a* which provides for the necessary multiplicity of contact points with said electrocatalytic sheet 12, and a coarse electroconductive screen 14*b* which provides for the overall electrical conductivity and rigidity of the current collector. The spacer 29 is directed to maintaining a predetermined gap between the membrane 2 and the anode assembly of the present invention. The spacer 29 may be constituted by one or more plastic meshes or by one or more plastic mattresses, directed to acting also as turbulence promoters of the electrolyte flow in the central compartment 41. When the spacer 29 is constituted by one or more plastic mattresses, the typical resulting resiliency transfers the pressure exerted by the cathode 3 onto membrane 2, to the hydrogen depolarized anode assembly of the invention thanks to the cooperative resistance of the rigid current collector 14*a* and 14*b*. The sealing along the periphery between cathodic compartment (40), membrane 2, central compartment (41), anode assembly of the present invention, gas chamber 4 is obtained by means of the gaskets 26.

Figure 2:
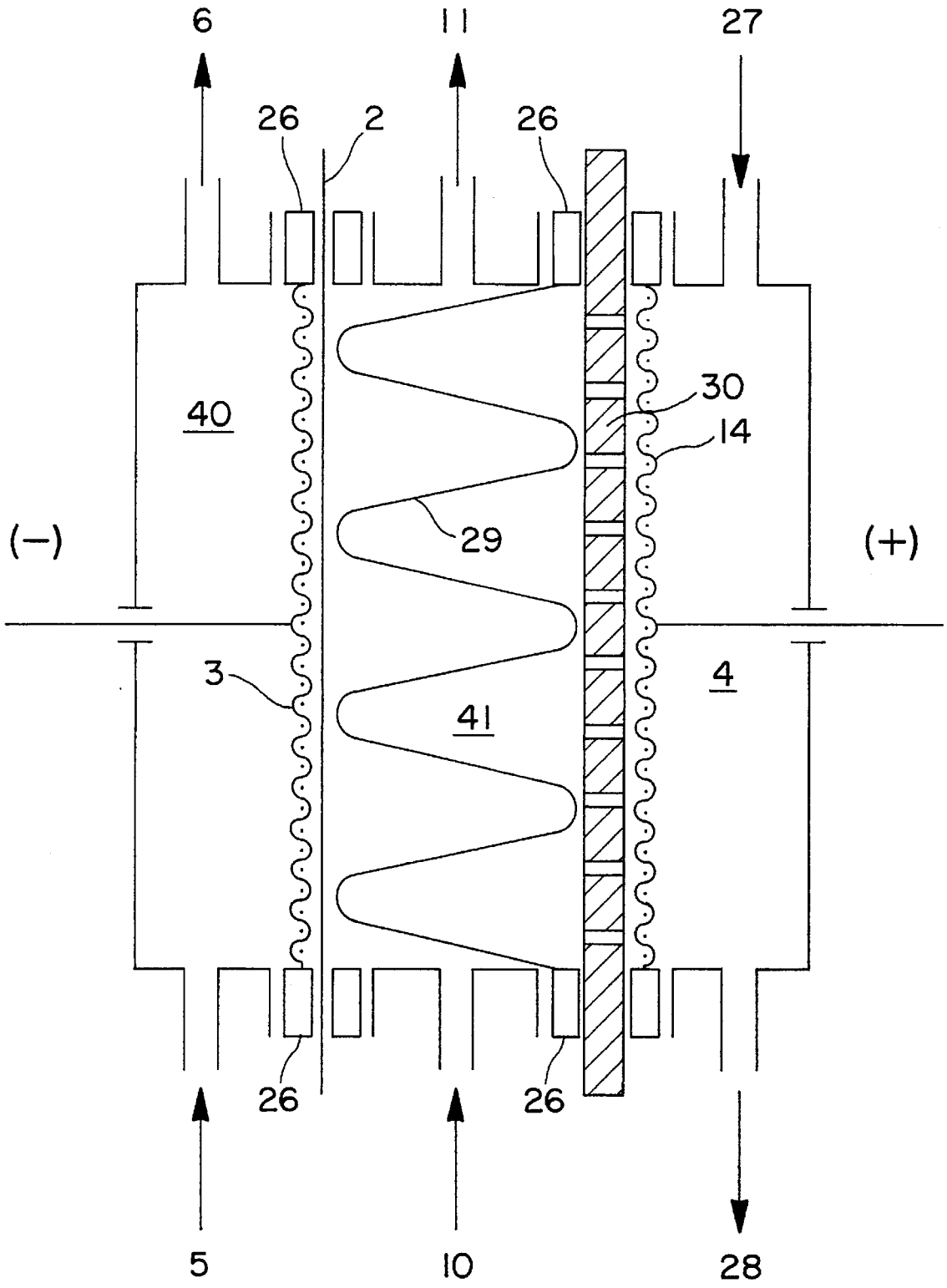
FIG. 2 is a further scheme of an electrolyzer provided with hydrogen depolarized anodes of the prior art.

FIG. 2 schematically shows an electrolyzer equipped with a hydrogen depolarized anode known in the art. Again the illustration is limited to only one elementary cell. The same parts illustrated in FIG. 1 are indicated by the same reference numerals with the exception of the hydrogen depolarized anode assembly which is constituted in this case only by a porous electrocatalytic sheet 30 made hydrophobic in order to maintain the liquid penetrating from the central compartment (41) blocked inside the pores. Said porous electrocatalytic sheet is in contact with the current collector 14. This kind of depolarized anode, as already said in the description of the prior art, is negatively affected by a series of inconveniences which hinder its industrial use, such as percolation of the solution, poisoning of the catalyst, reduction of reducible substances. These latter inconveniences are connected to the direct contact occurring between the catalyst of the porous sheet and the solution to be electrolyzed.

Figure 3:
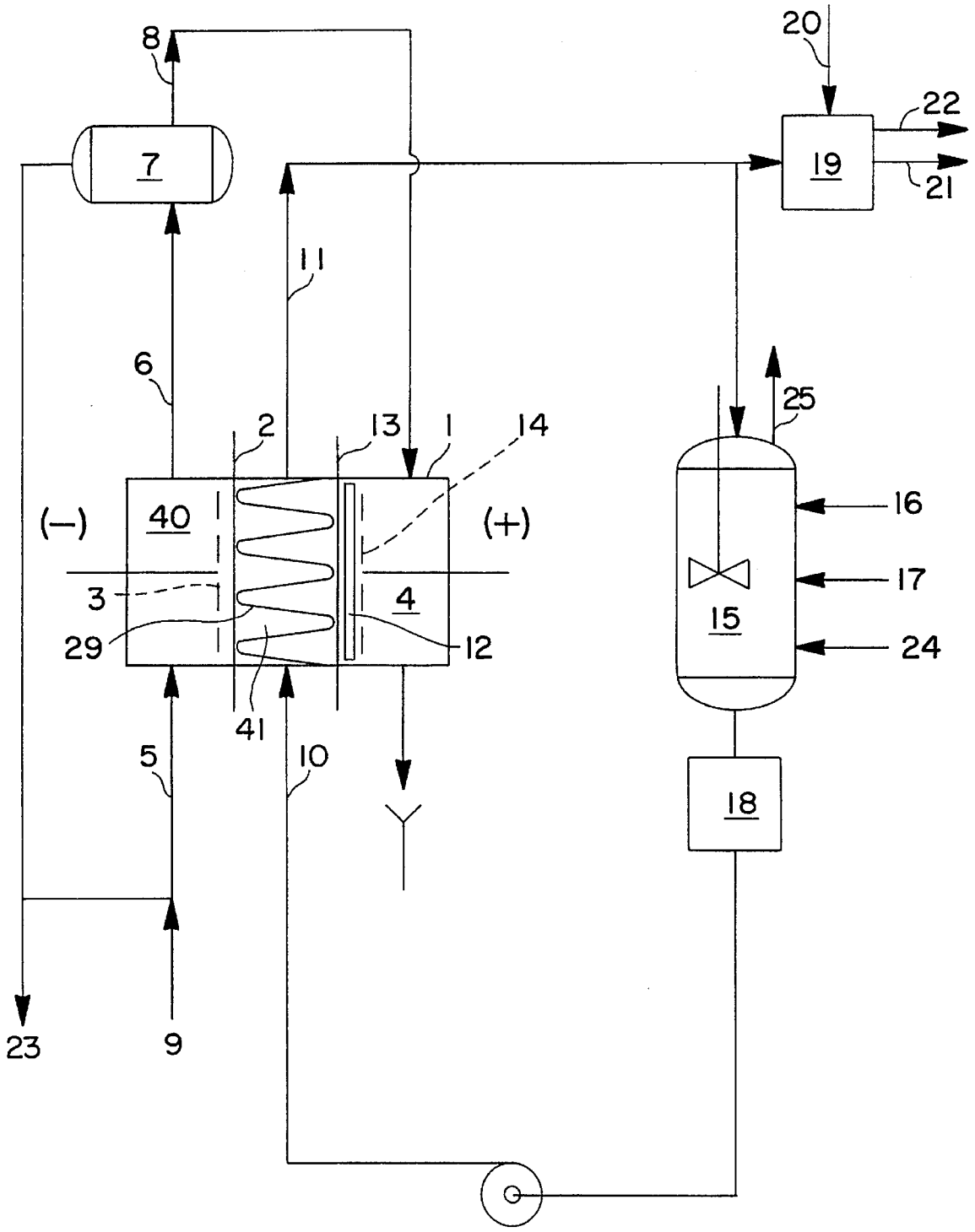
FIG. 3 is a scheme of a process for producing caustic soda by indirect electrolysis of sodium carbonate/bicarbonate carried out in an electrolyzer provided with hydrogen depolarized anode assemblies of the invention.

Making reference to FIG. 3, which resumes the distinctive features of an electrolysis process based on the electrolyzer of the present invention, electrolyzer 1, limited for simplicity sake to the illustration of one elementary cell, comprises the central compartment (41), the hydrogen gas chamber 4 containing the hydrogen depolarized anode assembly of the invention, the cathodic compartment (40) containing the cathode 3. In the following description, the process is assumed to consist in the electrolysis of a sodium sulphate solution. In this case, the cathodic compartment 40 and central compartment 41 are separated by a cation-exchange membrane 2. The sodium sulfate solution is fed in 10 into the central compartment 41. Due to the passage of electric current between the anode assembly of the present invention and the cathode 3, the following reactions take place:

cathode 3: hydrogen evolution with formation of $OH^-$ and migration of $Na^-$ through the membrane 2 from the central compartment 41 to the cathodic compartment 40 with production of caustic soda anode assembly of the present invention:hydrogen 8 produced at cathode 3 is scrubbed with water at controlled temperature to eliminate the caustic soda traces entrained therein (not shown in the figure). The scrubbed hydrogen is then fed to the hydrogen gas chamber 4 wherein no electrolyte is present, and flows to the back of the anode assembly of the present invention comprising the electrocatalytic porous sheet 12, pressed between a suitable porous current collector 14, previously described, and a cation-exchange membrane 13. Under electric current, hydrogen is ionized at the interface between the porous catalytic sheet 12 and the membrane 13. The $H^-$ ions thus formed migrate through the membrane 13 to the central compartment 41 where they substitute the $Na^-$ ions migrated into the cathodic compartment 40.

A net formation of sulfuric acid is thus obtained. Sulfuric acid may accumulate up to a maximum limit depending on the type of membrane 2, beyond which a decrease of the production efficiency of caustic soda is experienced. This decrease is due to an increasing migration of $H^-$ ions through membrane 2. The caustic soda solution containing hydrogen leaves the cathodic compartment (40) through 6 and is fed to gas disengager 7: wet hydrogen 8 is sent to scrubbing (not shown in the figure) and then fed to hydrogen gas chamber 4, while the caustic soda solution is recycled to the cell through 5. The necessary water is fed to the cathodic circuit of the cell through 9, to keep the desired concentration of caustic soda (generally in the range of 10–35%); the produced caustic soda is sent to utilization in 23. As far as the other electrolytic circuit is concerned, the acid sodium sulfate solution leaves the cell through 11 and is sent, totally or partially, to vessel 15 where the solution is added with crystal line sodium carbonate or bicarbonate or mixtures thereof 17, water 16 and, if required to keep a constant concentration of the electrolyte, sodium sulphate or sulphuric acid 24. The acidity produced in the cell is re-transformed into sodium sulfate with by-side formation of water and carbon dioxide.

Sodium carbonate or bicarbonate may also be provided as a solution. A wet and pure carbon dioxide flow 25 coming from 15 may be optionally compressed and utilized while the alkaline solution leaving 15 is sent to 18 where the carbonates and insoluble hydroxides of polyvalent metals may be filtered off. After purification, the salt solution, optionally added with a not neutralized portion, is recycled to the cell in 10.

The circulation of the sodium sulfate solution is provided by means of a pump, while circulation of the caustic soda solution may be obtained by gas lift recirculation.

As it is soon apparent, the process of the present invention utilizes sodium carbonate or bicarbonate or mixtures thereof to produce caustic soda to give the following reaction $$Na_2CO_3+2H_2O \text{--->} 2NaOH+H_2CO_3$$

$$H_2CO_3 \text{--->} H_2O+CO_2$$

Therefore, the process of the invention decomposes sodium carbonate or bicarbonate into the two components, that is caustic soda and carbonic acid which is unstable and decomposes in water and carbon dioxide. As a consequence, caustic soda is produced without any by-product which would involve difficulties for the commercialization as it is the case with the acid sodium sulfate or pure sulfuric acid.

Further, due to use of the hydrogen depolarized anode assembly of the present invention, the unitary cell voltage is only 2.3–2.5 Volts at 3000 Ampere/$m^2$, with an energy consumption of about 1800 kWh/ton of produced caustic soda.

The process of the invention does not directly electrolyze sodium carbonate as the acidification, which takes place in the central compartment 41, would produce scarcely soluble sodium bicarbonate, leading to precipitates inside the cell and plugging of the ducts. In order to avoid such problems, a high recirculation rate between the cell and vessel 15 should be provided. This would result in a penalization of the electrolysis process due to high energy consumption for recirculation and remarkable investment cost for the pumps and the relevant circuit comprising cell, vessel 15 and purification 18. In addition, as the electrical conductivity of the sodium carbonate/bicarbonate solutions is remarkably lower than the conductivity of the sodium sulfate/sulfuric acid solutions, a remarkably higher cell voltage would be experienced with respect to the one typical of the present invention.

Depending on the purity degree of the carbonate/bicarbonate fed to vessel 15 through 17, the system requires a certain purging: in this case, a portion of the acid solution of sodium sulfate is fed to a treatment unity 19 where neutralization is carried out.

A solution, absolutely indicative and anyway not limiting the present invention, foresees additioning calcium carbonate through 20 as a neutralizing agent, and then provides for separating precipitated calcium sulphate in 22. The liquid 21, made of sodium sulfate and impurities introduced together with the sodium carbonate or bicarbonate and accumulated in the circuit, is sent to discharge after dilution. An alternative solution consists in withdrawing part of the solution leaving vessel 15 or 18, providing then for purification, for example by evaporation or crystallization. In this case, the crystallized sodium sulfate is recycled through 24 while the mother liquor comprising a small volume of a concentrated solution of sodium sulfate enriched with the impurities is sent to discharge after dilution. It should be noted that the soluble impurity which most frequently accompanies carbonate or bicarbonate or mixtures thereof (in particular trona minerals) and therefore can accumulate in the sodium sulfate solution is represented by sodium chloride.

With oxygen-evolving anodes the presence of chlorides in the sodium sulfate solution would represent a substantial problem. In fact, chlorides are easily oxidized to chlorine which mixes with oxygen, still the main gaseous product. The presence of chlorine besides certain values prevents free venting of the oxygen to the atmosphere. For this reason, the concentration of chlorides in the sodium sulphate solution should be kept as low as possible by a substantial purging or alternatively chlorine-containing oxygen should be scrubbed with alkaline solutions. A remarkable improvement is obtained by using the hydrogen depolarized anode of the present invention.

In fact, the membrane 13 constitutes a physical barrier maintaining the liquid and the electrocatalytic sheet completely separated. Further, the internal structure of the cationic membrane, rich in negative ionized groups, exerts a strong repulsion onto the negative ions, such as the chlorides. Eventually, should the chlorides succeed in migrating through the membrane, they would not be oxidized by the electrocatalytic sheet whose voltage is maintained low by hydrogen.

Figure 4:
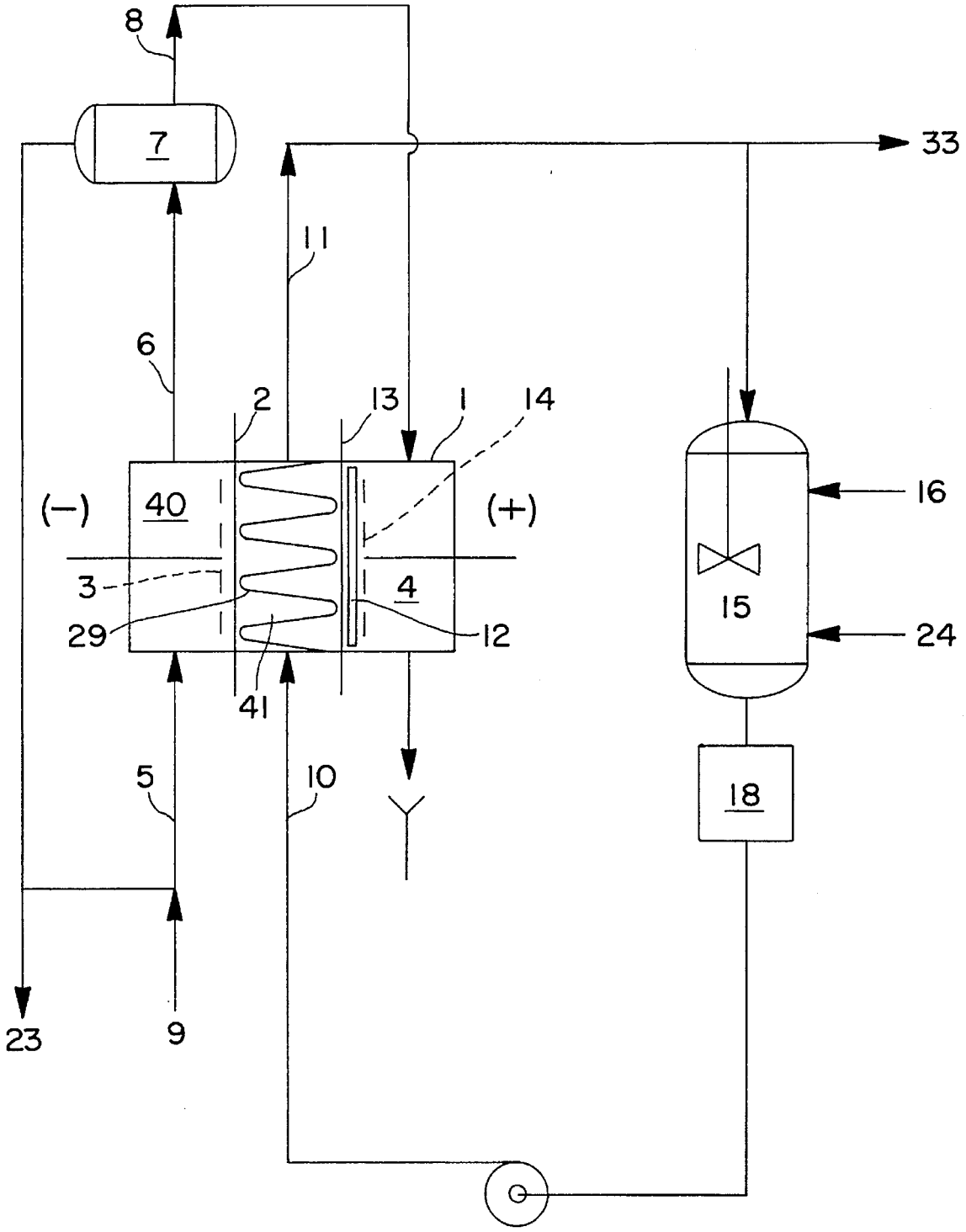
FIG. 4 is a scheme of a process for producing caustic soda and an acid solution of sodium sulfate by electrolysis of sodium sulfate in an electrolyzer provided with hydrogen depolarized anode assemblies of the invention.

If the acid solutions obtained in 11 in FIG. 3 may be directly utilized in the factory, the process of FIG. 3 may be suitably modified as illustrated in FIG. 4.

In this case, the raw material, fed in the circuit in 24, is preferably made of crystal sodium sulphate or sodium sesquisulphate or optionally solutions thereof. If necessary to the overall mass balance of the process, water may be added through 16. The solution leaving 15 is filtered from the insoluble substances in 18 and fed to electrolyzer 1 in 10. The electrolyzed liquid withdrawn in 11 is partly fed to 15 and partly sent to use in 33. Said liquid is made of a solution of sodium sulfate containing sulfuric acid, whose maximum concentration is determined by the need to avoid efficiency losses in the formation of sodium hydroxide due to transport of $H^-$ instead of $Na^-$ through membrane 2. However, said maximum concentrations are such as to make feasible the use of stream 33 in various chemical processes. The cathode side remains unvaried with respect to the description of FIG. 3. If the acid sodium sulfate solution is of no interest, the liquid withdrawn from 33 can be neutralized with calcium carbonate. In this event, the process uses sodium sulfate as the raw material and produces caustic soda as valuable product, pure carbon dioxide which may be liquefied and commercialized and calcium sulfate which may be dumped as inert solid waste or may be elaborated to make it suitable for use in the building industry.

Figure 5:
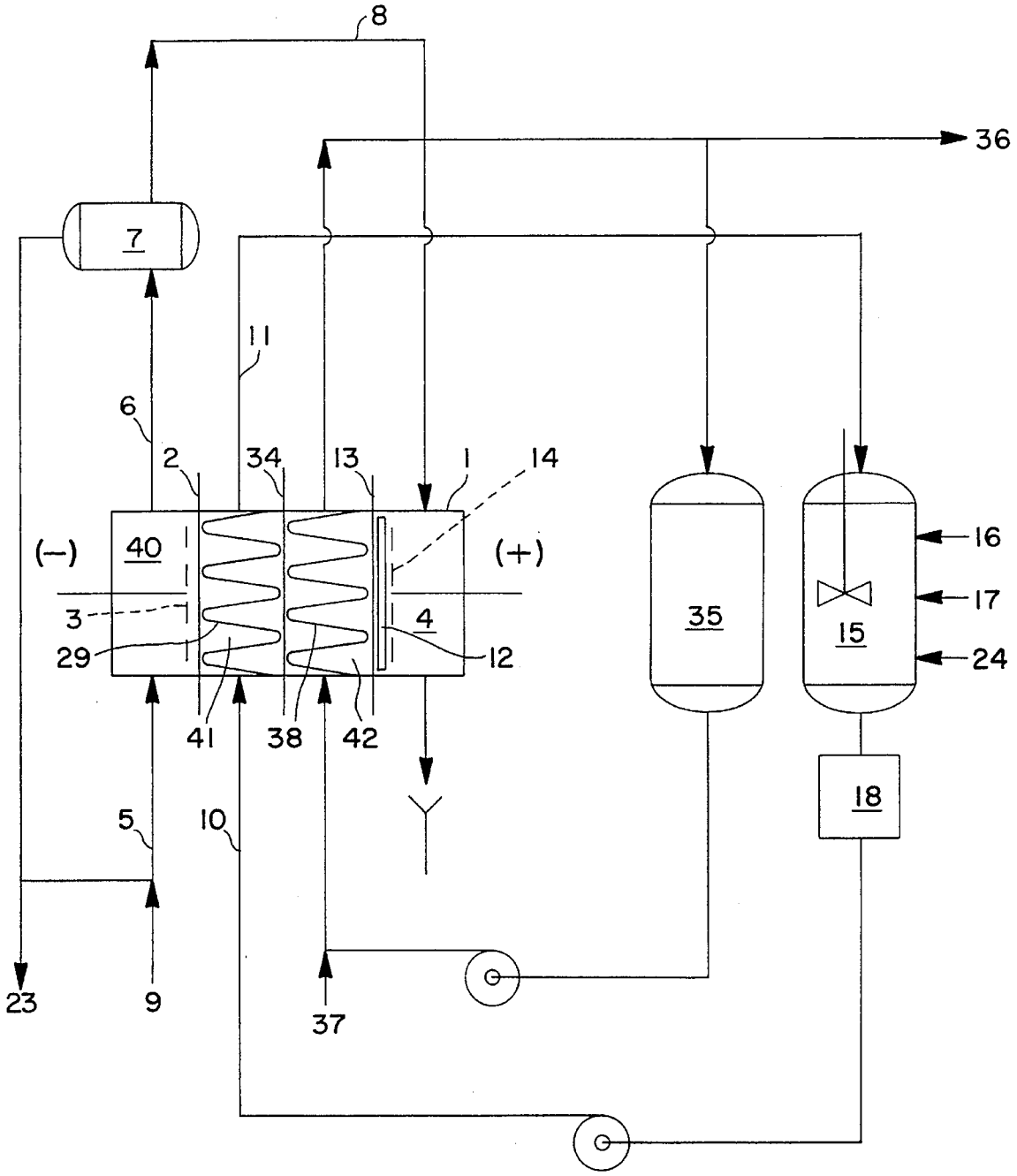
FIG. 5 shows an alternative embodiment of the process of FIG. 4 for producing caustic soda and pure sulfuric acid.

If production of pure sulfuric acid is preferred, the process of FIG. 4 may be converted into the one of FIG. 5. While the cathode side is unvaried with respect to FIG. 3, the sodium sulfate circuit foresees the addition of sodium sulfate in 24, with the possible addition of water and sodium carbonate to maintain the overall water balance and acidity within predetermined limits. While the sodium ions migrate through the cation-exchange membrane 2 forming caustic soda in the cathodic compartment 40, the sulfate ions migrate all the same through anion-exchange membrane 34, forming sulfuric acid in compartment 42 comprised between membrane 34 and the anode assembly of the present invention. The $H^+$ ions are supplied by the depolarized anode of the invention. The scheme is more complicated as it foresees a sulfuric acid circuit with a storage tank 35 and water injection in 37 to maintain the sulfuric acid concentration under control. The pure sulphuric acid is withdrawn in 36 and sent to use. The unitary cell is also more complicated as it comprises a further compartment 42 for the formation of sulfuric acid. The gap between membrane 2, and 34 and between membrane 34 and the anode assembly of the present invention is maintained by the two spacers 29 and 38, which may contribute, if required, to ensuring a certain resiliency to the internal structure of the electrolyzer, useful for exerting pressure onto the anode assembly of the present invention. As for the remaining parts, the unitary cell is the same as that of FIG. 1.

Although the best preferred source of hydrogen be represented by the hydrogen evolved at the cathode, it is evident that the depolarized anode of the invention may be fed with hydrogen coming from different sources (steam-reforming of hydrocarbons, refinery hydrogen, purge streams of various chemical processes, hydrogen from diaphragm chlor-alkali electrolyzers). Hydrogen may be diluted from inert gases, the only care being the elimination of possible poisons for the catalyst whereat the reaction of hydrogen ionization occurs (typically carbon monoxide, hydrogen sulfuric and their derivatives). As regards the operating temperature for the above mentioned embodiments, generally a range of 70°–90° C. is preferred to increase as far as possible the electric conductivity of the electrolytic solutions and of the membranes.

In the description of the above embodiments, reference has been made to a circulating electrolytic solution containing sodium sulfate only. This is intended only to provide an example. For example, in the case of indirect electrolysis of sodium carbonate/bicarbonate (FIG. 3) the circulating solution containing acid sodium sulfate could be substituted by a solution containing another salt, such as sodium acetate or mixtures of salts such as sodium acetate and sodium chloride.

Likewise, the process for producing an acid salt or a pure acid (FIGS. 4 and 5) may be adapted to the use of different salts other than sodium sulfate. For example, if sodium nitrate in the crystal form or as a solution is fed in 24 (FIGS. 4 and 5), a solution containing a mixture of residual sodium nitrate and nitric acid would be obtained in 33 (FIG. 4), or a pure nitric acid solution would be obtained in 36 (FIG. 5).

In the same way, if sodium chlorate is fed in 24 (FIGS. 4 and 5), a solution containing a mixture of sodium chlorate and chloric acid or alternatively a solution of pure chloric acid may be obtained. The possible presence of sodium sulfate or other salts in the solution containing sodium chlorate does not represent in any way a complication. Electrolysis would involve serious problems with hydrogen depolarized anodes known in the art (FIG. 2). As already said, in these anodes the electrolytic solution, hydrogen and catalyst come into direct contact in the pores, and therefore, the reduction of chlorate to chloride is unavoidable, with the consequent efficiency loss of the process.

Further, it can be said that the process of separation of a salt into the two parent components, the base and the acid, if carried out according to the teachings of the present invention, may be applied without any inconvenience to salts even of organic nature, such as alkaline salts of organic acids or halides or sulphates of organic bases.

In the following description some examples are given with the only purpose to better illustrate the invention, which is not intended to be limited by the same.

EXAMPLE 1

The cell illustrated in FIG. 1 was constructed by assembling two half-cells in transparent polymethacrylate and a frame made of the same material, the cross section of the three pieces being 10×10 $cm^2$. A pre fluorosulfonic acid cation-exchange membrane, Nafion® 324 produced by Du Pont (2 in FIG. 1) was inserted between the cathodic half-cell (cathodic compartment 40 in FIG. 1) and the frame, the peripheral edge being sealed by flat EPDM gasketing. A second cation-exchange membrane, Nafion® 117, by Du Pont (13 in FIG. 1) was positioned between the opposite side of the frame and the anodic half-cell (hydrogen gas chamber 4 in FIG. 1), the peripheral edge also sealed by flat EPDM (ethylene propylenediene methylene) gasketing. The side of the membrane facing the hydrogen gas chamber was held in contact with a flexible electrocatalytic and porous sheet (12 in FIG. 1). Such sheet had been obtained by sinterization under heat of platinum particles and particles of polytetrafluoroethylene according to known techniques, such as that described in U.S. Pat. No. 4,224,121. The anode current collector consisted in a rigid coarse expanded metal screen (**14*b* in FIG. 1) and a fine flexible expanded metal screen (14*a* in FIG. 1): the two screens had been previously attached together by spot-welding. The coarse screen and the fine screen were both made of titanium and coated by an electroconductive coating consisting in a mixture of oxides of the platinum group metals and valve metals as well known in the art. The cathode consisted in an expanded nickel mesh, 2 mm thick and was pressed against the Nafion® 324 membrane and the anode current collector against the anode assembly of the present invention, that is more particularly against the electrocatalytic sheet. The Nafion® 324 membrane and the anode assembly of the present invention were held in position by the resilient reaction of the spacer (29 in FIG. 1) inserted inbetween and made of a plurality of superimposed layers of polypropylene expanded mesh. The gap between the Nafion® 324 membrane and the anode assembly of the present invention was about 3 mm. The cell was inserted in the circuit illustrated in FIG. 3**, having a total volume of 8 liters.

15% caustic soda was initially fed to the cathodic compartment (40 in FIG. 1) and 16% sodium sulfate was fed to the circuit formed by the central compartment (41 in FIG. 2) of the cell, vessel 15, purification 18 (consisting of a filter for the insolubles) and the effluent treatment section 19. The hydrogen gas chamber (4 in FIG. 1) was fed with pure hydrogen coming from the cathodic compartment, suitably washed in a scrubber not shown in the figure. The circuit was fed with solid sodium carbonate containing 0.03% of sodium chloride. Chloride accumulation was kept around 1 gram/liter by discharging a few milliliters of solution per hour. The total current was 30 Ampere and the temperature 80° C. The hydraulic heads of the circulating solutions of caustic soda and sodium sulfate were suitably adjusted in order to maintain the Nafion® 117 membrane pressed against the electrocatalytic sheet and the current collector, and the Nafion® 324 membrane pressed against the polypropylene spacer. Under these conditions, the system produced about 40 grams/hour of 17% caustic soda (faradic yield about 90%) with an average consumption of about 50 grams/hour of sodium carbonate as $Na_2CO_3$ and about 15 liters/hour (at ambient temperature) of hydrogen.

The cell voltage was recorded with time as a function of the type of coarse and fine screens shown below:

1. coarse, flattened, expanded metal sheet: plain titanium, 3 mm thickness, short and long diagonals of the diamond-shaped apertures being 10 and 20 mm long respectively;
2. same as 1, but 1 mm thickness;
3. same as 2 but 1.5 mm thickness, short and long diagonals being 4 and 8 mm respectively;
4. fine, flattened expanded metal sheet: titanium coated with 0.5 microns of galvanic platinum, 1 mm thickness, short and long diagonals of the diamond-shaped apertures being 2 and 4 mm respectively,
5. same as 4 but short and long diagonals being 6 and 12 mm respectively;
6. same as 4 but 0.5 mm thickness and short and long diagonals being 1.5 and 3 mm, respectively;
7. perforated titanium sheet, 1 mm thickness, 1.5 mm diameter holes, provided with a 0.5 micron galvanic platinum coating;
8. perforated titanium sheet, 0.3 mm thick, 1 mm diameter holes provided with a 0.5 micron galvanic platinum coating.

Table 1 reports the results thus obtained, which were all stable with time.

TABLE 1

Cell voltage as a function of the geometry of the current collector

| Coarse and Fine Screens Combinations | Cell Voltage Volts |
|---|---|
| 1 + 4 | 2.4 |
| 1 + 5 | 2.6 |
| 1 + 8 | 2.2 |
| 2 + 4 | 2.5 |
| 2 + 8 | 2.3 |
| 3 + 4 | 2.4 |
| 3 + 5 | 2.6 |
| 3 + 6 | 2.3 |
| 3 + 7 | 2.2 |

These results clearly show that when the material used for the current collector is titanium the cell voltage increases with a thickness of the coarse screen as low as 1 mm with the diagonals of the apertures as long as 20 mm. Most probably these cell voltage increases are due to ohmic losses in which case the critical thickness and dimensions of the diagonals of the apertures are a function of the electrical conductivity of the metal. As regards the fine titanium screen, the data reported in Table 1 show that the thickness does not influence the performances in the tested range. Most probably thicknesses over 1 mm would give less satisfactory performances due to the lower flexibility and consequent lower conformability of the fine screen to the profile of the coarse screen. Conversely, the dimensions of the apertures are extremely influent on the performances and the value of 12 mm appears to be the maximum allowable limit. The strong increase of the cell voltage with 12 mm is probably due to the fact that an excessive portion of electrocatalytic sheet remains un-compressed thus missing contact with the membrane. It is, therefore, considered that this limit be valid irrelevant from the type of material used to produce the fine screen.

It should be considered that as the cell was not provided with oxygen evolving anodes, the problems connected with the evolution of chlorine gas were eliminated. Therefore, with the process of the present Example the maximum limit of chlorides accumulation may be largely increased with respect to the value of 1 gram/liter utilized in this example, with a consequent remarkable reduction of the purge.

EXAMPLE 2

The 3+7 combination of Table 1 in Example 1 has been substituted with a similar combination made by the same coarse expanded titanium sheet provided with a 0.5 micron galvanic platinum coating and a fine wire mesh in a Hastelloy® C-276 nickel alloy, simply pressed against the coarse expanded titanium sheet, said wire mesh being obtained with 0.5 mm diameter wires spaced 1 mm apart. The result is the same as that obtained with the 3+7 combination, thus, demonstrating that the type of material in contact with the electrocatalytic sheet is not critical and the spot-welding between the fine and the coarse screens is not an instrumental requirement.

The fine wire mesh in Hastelloy® C-276 has been then substituted with a flexible sheet of sinterized titanium, having a thickness of 0.5 mm and provided with a coating of mixed ruthenium and titanium oxide, obtained by thermal decomposition of a solution containing precursor compounds soaked in the sheet. Also, in this case, the sheet was simply pressed against the coarse expanded titanium mesh provided with a 0.5 micron galvanic platinum coating. The results were the same as those of the 3+7 combination, further demonstrating that the necessary requirements for the fine screen are the flexibility and the multiplicity of contact points with the electrocatalytic sheet, while its structure, that is the way such flexibility and multiplicity of contact point are provided, is not determinant.

EXAMPLE 3

The cell used for Example 1 was disassembled and the current collector (coarse and fine metal screen) was substituted by a sheet of porous graphite having a thickness of 10 mm and an average diameter of the pores of about 0.5 millimeters. The remaining components were not changed and the cell was reassembled and inserted in the same electrolysis circuit of Example 1. The cell operated with a cell voltage comprised between 2.3 and 2.4 Volts, substantially stable with time. A similar result was obtained using, instead of the graphite sheet, a 10 mm thick stainless steel sponge (also known as reticulated metal) sheet having pores with an average diameter of 1 mm. These two experiments showed that the current collector in order to achieve the objects of the present invention may be constituted also by a single element, provided that this element combines the characteristics of ensuring homogeneous distribution of current, rigidity and multiplicity of contact points with the electrocatalytic sheet. However, the current collector made of a single element is characterized by high costs (sinterized metal, metal sponge) and brittleness (porous graphite sheet). For these reasons the current collector comprising the coarse screen and the fine screen of Example 1 and 2 represents the best preferred embodiment of the present invention.

EXAMPLE 4

The cell used for the test described in Example 3 was subsequently disassembled and the metal sponge sheet was substituted by a coarse expanded titanium screen alone, with the same characteristics as those specified for number 1 in Example 1. Said screen was provided with a 0.5 micron galvanic platinum coating. The remaining components were not changed and the cell was reassembled and inserted in the electrolysis circuit. Operating under the same conditions as previously illustrated, a cell voltage of 3.4 Volts was detected which demonstrates that the number of contact points between the current collector and the electrocatalytic sheet was insufficient.

In a further test, the single coarse expanded titanium screen was substituted by a fine expanded titanium screen having the same characteristics specified for number 4 in Example 1 and provided with a 0.5 micron galvanic platinum coating. The cell was then operated at the same conditions as previously illustrated and the cell voltage resulted comprised between 2.8 and 2.9 Volts. In this case the higher cell voltage may be substantially ascribed to the ohmic losses due to the excessive thinness of the current collector. For this reason a further test was carried out with a current collector made of a single expanded titanium screen having a thickness of 3 mm and with short and long diagonals of the diamond shaped apertures of 2 and 4 mm respectively. Again the cell voltage resulted comprised between 2.8 and 3 Volts. The reason for this high cell voltage is to be found in the width of the portions of solid metal of the screen resulting of about 2 mm, a value which cannot be reduced for technological production problems. This excessive width determines a partial blinding of the electrocatalytic sheet, thus making part of the catalyst not available to hydrogen gas. Said width can be reduced to 1 mm or less only when the expanded metal screen has a sufficiently low thickness, indicatively 1 mm or less.

As it can be seen, the requisite of providing for homogeneous distribution, rigidity, multiplicity of the contact points at the same time cannot be obtained by a single expanded metal screen.

EXAMPLE 5

The 3+7 combination of Example 1 has been further tested substituting the flexible electrocatalytic sheet obtained by sinterization of particles of electrocatalyst and binder with a flexible electrocatalytic sheet made of activated carbon felt produced by E-TEK Inc., U.S.A. under the trade-mark of ELAT®.

Also, in this case, the performances were the same as reported in Table 1 of Example 1.

Furthermore, the 3+7 combination was tested substituting the flexible activated carbon felt with an activated carbon sheet obtained by applying a platitnum electrocatalyst obtained by thermal decomposition of a suitable precursor solution on a porous carbon sheet manufactured by Toray Co., Japan under the trade name of TGPH 510.

This carbon sheet is scarcely flexible, and the contact with the current collector results are rather poor even under the pressure exerted on the membrane by the electrolyte and by the internal resilient structure of the cell as a consequence of the inability of the carbon sheet to conform to the profile of the current collector which cannot be perfectly planar. The cell voltage resulted 3.2 Volts with a tendency to increase with time. This test clearly shows that besides the characteristics of thickness, rigidity and multiplicity of contact points typical of the current collector, it is essential that the electrocatalytic sheet be flexible.

EXAMPLE 6

The cell with the 3+7 combination of Example 1 was used under the same operating conditions of Example 1 the only exception being that the sodium sulfate solution was purposedly added with few milligrams per liter of lead and mercury ions, which are well-known poisons for the hydrogen ionization reaction. The cell voltage did not change: this surprising resistance to deactivation is a result of the presence of the membrane (13 in FIG. 1) which acts as an effective protecting barrier between the poison-containing solution and the electrocatalytic sheet (12 in FIG. 1).

The same electrolysis was performed with a cell equipped with a hydrogen depolarized anode as described in EP 0357077. Such electrolysis had to be interrupted after a quite short time of operation in view of an unbearable increase of the cell voltage most likely due to poisoning of the catalyst wetted by the solution inside the pores of the sheet.

EXAMPLE 7

The same test illustrated in Example 1 with the 3+7 combination, was repeated changing the circulating solution and the operating temperature which was 65° C. Sodium sulphate was substituted by:

sodium chloride, 200 grams/liter sodium acetate, 250 grams/liter mixture of 10% sodium sulfate and 10% sodium acetate mixture of 10% sodium chloride and 10% sodium acetate.

There results were the same as those reported in Example 1, thus showing the function of carrier of acidity may be performed by different types of salts other than sodium sulphate). The only differences were connected to the strength of the generated acid, which is high for hydrochloric acid, medium for sulfuric acid and weak for acetic acid. The maximum accumulation of acid, before the decline of the faradic efficiency for the production of caustic soda decreased as the acid strength increased. Therefore, the acid solution flow rates (to the vessel 15 in FIG. 3) had to be proportionally varied. The best results were obtained with mixtures of salts where a salt of the strong acid, sodium chloride, was directed to ensure a high electrical conductivity, while a salt of the weak acid, sodium acetate, was directed to act as an acidity accumulator. In particular, with a solution containing 10% of sodium chloride and 10% of sodium acetate a voltage of 2.5 Volts was detected with a total current of 30 Ampere (3000 Ampere/$m^2$) and an energy consumption of 1.9 kWh/kg of produced caustic soda.

EXAMPLE 8

The cell equipped with the hydrogen depolarized anode assembly of the invention, illustrated in Example 1 for the 3+7 combination, was used in a circuit as illustrated in FIG. 4. The general conditions were as follows:

circulating solution concentration:120 grams/liter of sulfuric acid and 250 grams/liter of sodium sulfuric; a portion of the solution was continuously withdrawn (33 in FIG. 4)

feed (15 in FIG. 4:solid sodium sulphate, technical grade total current:30 Ampere (3000 Ampere/$m^2$)

temperature: 80° C.

caustic soda 17% hydraulic heads of caustic soda and of the acid solution of sodium sulphate adjusted in order to maintain the Nafion® 117 membrane and the electrocatalytic sheet pressed against the current collector and the Nafion® 324 membrane pressed against the polypropylene spacer.

The cell voltage resulted 2.3 Volts with an energy consumption of 1.8 kWh/kg of produced caustic soda. The results have not substantially changed by feeding alkaline sodium sulfate or sodium sesquisulfate.

EXAMPLE 9

The operating conditions were the same as in Example 8 except for the fact that the acid solution was not withdrawn but completely neutralized with chemically pure calcium carbonate in grains (fed to 15 in FIG. 4). Also crystal sodium sulphate and water were added to the circuit. The overall reaction was the conversion of sodium sulphate, calcium carbonate and water in caustic soda, calcium sulphate (filtered in 18 in FIG. 4) and carbon dioxide. No particular difficulty was encountered in obtaining a stable operation with a total current of 30 Ampere and a cell voltage of 2.4 Volts,, producing 40 grams/hour of 18% caustic soda (90% faradic efficiency, 1.9 kWh/ton) and about 70 grams/hour of solid calcium sulfate, with a consumption of 70 grams/hour of sodium sulfate as $Na_2SO_4$ and 50 grams/hour of calcium carbonate. As it is evident, according to this alternative embodiment of the present invention, the acid solution of Example 8 is substituted by solid calcium sulfate which may be damped as inert solid waste or used in the building industry upon suitable treatment.

EXAMPLE 10

The electrolysis process of a sodium sulfate solution of Example 8 has been repeated in the most complex embodiment of FIG. 5. The cell was prepared assembling two half-cells in transparent methacrylate, and two frames made of the same material, the cross-section being 10×10 $cm^2$. A cation exchange membrane Nafion® 324 by Du Pont Co. (2 in FIG. 5) was positioned between the cathodic half-cell and the first frame, with the peripheral edge sealed by flat EPDM gasketing. A second anion-exchange membrane made of a polymeric hydrocarbon containing ammonium groups sold under the mark Selemion® AAV by Asahi Glass (numeral 34 in FIG. 5), was positioned between the first and the second frame, the peripheral edge being sealed by flat EPDM gasketing. The hydrogen-depolarized anode assembly of the invention, comprising a Nafion® 117 membrane (13 in FIG. 5), an electrocatalytic graphitized carbon felt produced by E-TEK Inc. U.S.A., under the trademark of ELAT® (12 in FIG. 5) and the 3+7 combination of Example 1 as the current collector (14 in FIG. 5) was then positioned between the second frame and the hydrogen gas chamber (4 in FIG. 5). The distance between the membranes, corresponding to the thickness of each frame and the relevant gaskets, was 3 mm and the relevant space was filled with resilient spacers (29 and 38 in FIG. 5) made of a plurality of layers of large mesh fabric made of polypropylene. The cathode (3 in FIG. 5) and the current collector (14 in FIG. 5) were pressed against the membranes, held in firm position by the resilient reaction of the spacers. The solutions initially fed to the cell were 15% caustic soda, 16% sodium sulphate and 5% sulfuric acid. Chemically pure sodium sulfate, water to maintain volume and concentrations unvaried, and caustic soda to maintain the sodium sulfate solution close to neutrality, were fed to the circuit (15 in FIG. 5). At a total current of 30 Ampere the system, continuously operating at 3.7 Volts at 60° C., produced 40 grams/hour of 17% caustic soda (faradic efficiency: 90%) and 41 grams/hour of 12% sulfuric acid (faradic efficiency: 75%) with an average consumption of 60 grams/hour of solid sodium sulfate and 6.5 grams/hour of caustic soda. The energy consumption was 2.9 kWh/kg of produced caustic soda, reaching 3.3 kWh/kg of really available caustic soda taking into account the caustic soda consumption required for maintaining the neutrality of the sodium sulphate solution.

EXAMPLE 11

The cell equipped with the hydrogen-depolarized anode assembly of Example 10 was operated at the same conditions but substituting the crystal sodium sulfate and the 16% sodium sulfate solution, respectively, with chemically pure, solid sodium chloride and a 20% sodium chloride solution. At the same operating conditions, a 18% caustic soda solution and a 2% hydrochloric acid solution were obtained with the same faradic efficiency and reduced energy consumptions. It should be noted that the presence of the anode assembly avoids the formation of chlorine which would irreversibly damage the anionic membrane. Similar results were obtained by using a 15% sodium nitrate solution and crystal sodium nitrate, obtaining in this case a 15% caustic soda solution and a 3% nitric acid solution, always under stable operating conditions and with high faradic efficiencies and low energy consumptions. The cell of this Example 11 has also been used for the electrolytic decomposition of salts of organic acid or bases. In the first case, the cell was operated with an initial 12% sodium lactate solution and with solid sodium lactate. Operating at the same conditions of Example 10, a 13% caustic soda solution and a 10% lactic acid solution were obtained with high faradic efficiencies and low energy consumptions and absence of by-products. The conventional technique with anodes for oxygen evolution would be quite unsatisfactory as the lactic acid does not resist to anodic oxidation, as it happens with most organic acids. Moreover, the cell with a hydrogen anode assembly of the present invention was used for electrolytically decomposing tetraethylammonium bromide, under the conditions described above for sodium lactate. Instead of caustic soda, a tetraethylammonium hydroxide solution and a 2% bromidric acid solution were obtained without the concurrent formation of bromine which would quickly damage the delicate anionic membrane. The faradic efficiency was still high and the energy consumption particularly low.

EXAMPLE 12

The same test illustrated in Example 8 was repeated substituting the circulation solution consisting in sodium sulfate and sulfuric acid, first with a solution initially containing about 600 grams per liter of sodium chlorate and subsequently with a solution initially containing 200 grams per liter of sodium sulfate and 200 grams per liter of sodium chlorate. In both cases the operating conditions were as follows:

| | |
|---|---|
| temperature | 60° C. |
| total current | 30 Ampere (300 Ampere/m2) with a cell voltage of about 2.3 V |

14% caustic soda solid sodium chlorate in the first case and sodium chlorate plus sodium sulfate in the second (fed to 15 in FIG. 4)

hydraulic heads of the caustic soda and sodium chlorate solutions such as to maintain the Nafion® 117 membrane (13 in FIG. 4) and the electrocatalytic sheet (12 in FIG. 4) pressed against the current collector (14 in FIG. 4) and the Nafion® 324 membrane (2 FIG. 4) pressed against the polypropylene spacer.

The energy consumption resulted about 2 kWh/kg of caustic soda. The maximum acidity which could be obtained in the circulating acid salt solution before observing an evident decline of the current efficiency was about 0.5–1 Normal in the first case and about 2–2.5 Normal in the second case.

An attempt to repeat the test substituting the hydrogen depolarized anode of the invention with the depolarized anode described in EP 0357077 failed after a few hours of operation due to the remarkable reduction of chlorate to chloride occurring in the pore of the electrodes where the electrolytic solution, hydrogen and catalyst particles came into direct contact.

We claim:

1. Electrolyzer for the electrolysis of a solution of a salt for the production of a solution containing an acid and a solution of a base, said electrolyzer comprises at least one elementary cell divided into a first, a central and a third compartment by means of a first and a second cation-exchange membrane, the first of said compartments contains the first of said membranes and a cathode for the hydrogen evolution and the production of the base, the central compartment, defined by said cation-exchange membranes, is further divided into two parts by an anion-exchange membrane, the third compartment contains the second of said cation-exchange membranes and an anode, said anode comprises a porous electrocatalytic sheet for hydrogen ionization and a porous rigid current collector, characterized in that said current collector has a multiplicity of contact points and said porous electrocatalytic sheet is flexible and is held in contact with said second membrane and said current collector by means of pressure without bonding.

2. The electrolyzer of claim 1 characterized in that the second of the cation-exchange membrane of said assembly is an acid resistant membrane.

3. The electrolyzer of claim 1 characterized in that said electrocatalytic sheet consists in a carbon or graphitized laminate containing an electrocatalyst for the ionization of hydrogen.

4. The electrolyzer of claim 1 characterized of that said electrocatalytic sheet consists of a film comprising a binder and electroconductive and electrocatalytic particles for the ionization of hydrogen.

5. The electrolyzer of claim 1 characterized of that said electrocatalytic sheet consists in a fine metal wire mesh provided with a coating comprising an electrocatalyst for the ionization of hydrogen.

6. The electrolyzer of claim 1 characterized of that said electrocatalytic sheet consists of a sinterized metal sheet comprising an electrocatalyst for the ionization of hydrogen.

7. The electrolyzer of claim 1 characterized in that said current collector is made of valve metal and is provided with an electroconductive coating.

8. The electrolyzer of claim 1 characterized in that said current collector comprises a porous, coarse, rigid metal screen and a porous, fine, flexible metal screen in contact with each other.

9. The electrolyzer of claim 8 characterized in that said coarse metal screen and said fine metal screen are connected together by means of spot-welding.

10. The electrolyzer of claim 8 characterized in that said coarse metal screen is coarse expanded metal sheet and said fine metal screen is fine expanded metal sheet.

11. The electrolyzer of claim 10 characterized in that the said coarse expanded metal sheet has a minimum thickness of 1 millimeter and has apertures with diagonals with a maximum length of 20 millimeters.

12. The electrolyzer of claim 1 characterized in that said pressure is pressure exerted by the solution in contact with a side of said second cation-exchange membrane opposite with respect to that in contact with said electrocatalytic sheet.

13. The electrolyzer of claim 1 characterized in that said pressure is the pressure exerted by resilient means.

14. A method of electrolysis of a solution of a salt for the production of a solution containing an acid and a solution containing a base, carried out in an electrolyzer which comprises at least one elementary cell divided into a first, a central and a third compartment by means of a first and a second cation-exchange membrane, the first of said compartments contains the first of said membranes and a cathode for the hydrogen evolution and the production of the base, the central compartment defined by said cation-exchange membranes is further divided into two parts by an anion-exchange membrane, the third compartment contains the second of said cation-exchange membranes and an anode, said anode comprises a porous electrocatalytic sheet for hydrogen ionization and a porous rigid current collector, said method comprises:

feeding the solution of the base to an inlet of the first compartment withdrawing a more concentrated solution of the base and hydrogen from an outlet of said first compartment feeding the solution of the salt to an inlet of the part of the central compartment defined by said first cation-exchange membrane and the anion-exchange membrane, withdrawing an exhausted solution of the salt from an outlet of said part of the central compartment, withdrawing a solution of the acid from an outlet of the part of the central compartment defined by the anion-exchange membrane and said second cation-exchange membrane feeding a hydrogen-containing gaseous stream to an inlet of said third compartment venting rest gas from an outlet of said compartment characterized in that the hydrogen gas diffuses throughout the porous current collector and the porous electrocatalytic sheet and it is ionized at the interface between said electrocatalytic sheet and the membrane to form $H^+$ ions and said $H^+$ ions migrate through the membrane into said solution of the acid, said electrocatalytic sheet, said membrane and said current collector are held in contact by means of pressure without bonding.

* * * * *